US006497218B2

(12) United States Patent
Warner et al.

(10) Patent No.: US 6,497,218 B2
(45) Date of Patent: Dec. 24, 2002

(54) FUEL INJECTOR MODULE

(75) Inventors: William M. Warner, Summerville, SC (US); Jaihind S. Sumal, Mount Pleasant, SC (US); Elwood B. Crosby, Charleston, SC (US)

(73) Assignee: Robert Bosch Corporation, Broadview, IL (US)

( * ) Notice: Subject to any disclaimer, the term of this patent is extended or adjusted under 35 U.S.C. 154(b) by 0 days.

(21) Appl. No.: 09/795,251

(22) Filed: Feb. 28, 2001

(65) Prior Publication Data

US 2002/0117151 A1 Aug. 29, 2002

(51) Int. Cl.[7] ..... F02M 55/02
(52) U.S. Cl. ..... 123/468; 123/456
(58) Field of Search ..... 123/470, 456, 123/447, 468, 469, 472, 525, 527; 239/585.1, 533.2

(56) References Cited

U.S. PATENT DOCUMENTS

| | | | | | |
|---|---|---|---|---|---|
| 4,771,751 | A | * | 9/1988 | Haigh et al. | 123/470 |
| 4,982,716 | A | | 1/1991 | Takeda et al. | |
| 5,086,743 | A | | 2/1992 | Hickey | |
| 5,088,463 | A | * | 2/1992 | Affeldt et al. | 123/459 |
| 5,111,794 | A | * | 5/1992 | DeGrace, Jr. | 123/470 |
| 5,168,857 | A | | 12/1992 | Hickey | |
| 5,172,671 | A | | 12/1992 | Peters et al. | |
| 5,189,782 | A | | 3/1993 | Hickey | |
| 5,215,063 | A | | 6/1993 | Yeh | |
| 5,220,900 | A | | 6/1993 | Wakeman | |
| 5,398,656 | A | | 3/1995 | Brisbane et al. | |
| 5,531,202 | A | | 7/1996 | Lorraine | |
| 5,577,480 | A | | 11/1996 | Gmelin et al. | |
| 5,598,824 | A | | 2/1997 | Treusch et al. | |
| 5,616,037 | A | | 4/1997 | Lorraine et al. | |
| 5,657,733 | A | | 8/1997 | Dozier et al. | |
| 5,718,206 | A | | 2/1998 | Sawada et al. | |
| 5,881,701 | A | * | 3/1999 | King et al. | 123/527 |
| 5,934,253 | A | | 8/1999 | Kojima et al. | |
| 5,980,335 | A | * | 11/1999 | Barbieri et al. | 439/824 |
| 6,053,148 | A | * | 4/2000 | Glovatsky et al. | 123/470 |
| 6,131,824 | A | * | 10/2000 | Fly | 239/408 |
| 6,227,170 | B1 | * | 5/2001 | Koshiba | 123/456 |

* cited by examiner

*Primary Examiner*—Willis R. Wolfe
*Assistant Examiner*—Mahmoud Gimie
(74) *Attorney, Agent, or Firm*—Michael Best & Friedrich LLP

(57) ABSTRACT

A fuel injector module for an internal combustion engine having two banks of cylinders includes a longitudinally extending central portion with opposing sides, at least two branches extending laterally from one of the opposing sides, and at least two more branches extending laterally from the other of the opposing sides. Each of the branches includes an injector receptacle for housing a fuel injector that injects fuel into a respective cylinder. Each of the branches also includes an electrical connector adjacent the injector receptacle for providing electrical power to the fuel injector. Preferably, each of the electrical connectors includes a pogo-pin electrically coupled to the fuel injector.

37 Claims, 4 Drawing Sheets

FUEL INJECTOR MODULE

FIELD OF THE INVENTION

The invention relates to automotive fuel systems, and more particularly to a fuel injection system for supplying fuel to an internal combustion engine.

BACKGROUND OF THE INVENTION

It is known to use fuel injectors to inject fuel from a fuel rail into an engine intake manifold. Typically, the fuel inlet end of the fuel injectors communicates with a fuel rail, which supplies fuel to the injectors. The fuel outlet end of the fuel injectors is supported in an air intake manifold, which mixes the fuel with the proper amount of air prior to combustion. The fuel injectors must be long enough to bridge the gap between the fuel rail and the intake manifold. Fuel injectors come in a variety of standard lengths to accommodate different fuel system envelopes. One example of such a fuel injection system is seen in U.S. Pat. No. 5,531,202.

These standard length fuel injectors include a functional portion that is required for the operation of the fuel injector. This functional portion is often relatively short with respect to the overall length of the injector. To obtain the necessary overall length, the fuel injector often includes an extension tube, an extended body portion, an extended needle valve assembly, an electrical connection extension and other added features or components. Adding length to the fuel injector increases the costs of the injector due to increased material usage and increased assembly costs.

In these typical fuel systems, the injectors are exposed to the harsh environment of an internal combustion engine. To protect the injectors from the environment it is necessary to overmold the fuel injectors with a protective layer or overmolding, typically a plastic. Overmolding the injector adds additional costs.

It is also known to mount a shorter fuel injector in a fuel rail and to mount the fuel rail directly to the intake manifold. This helps eliminate the costs associated with lengthening the fuel injector to bridge a gap between the fuel rail and the intake manifold. Additionally, housing the injector inside the fuel rail can eliminate the need for overmolding. The space required between the fuel rail and the intake manifold is also reduced, thereby reducing the overall packaging envelope for the fuel injection system. U.S. Pat. Nos. 5,718,206 and 5,172,671 illustrate two such prior art fuel injection systems.

In engines having two banks of cylinders, it is common to utilize two metallic fuel rail assemblies that are connected together at one end by a crossover tube providing fluid communication between the two fuel rail assemblies. The ends of the crossover tube are typically brazed to the opposing fuel rail assemblies to provide the necessary connections. The resulting fuel rail assembly is substantially U-shaped. It is also known to form an integral, non-metallic U-shaped fuel rail assembly for engines having two cylinder banks.

SUMMARY OF THE INVENTION

The present invention provides an improved module for packaging fuel injectors, and more preferably, for packaging only the functional portion of the fuel injectors between a fuel supply and an intake manifold. Extension tubes, extended body portions, extended needle valve assemblies, electrical connection extensions and any other features or components needed to elongate the injectors are eliminated, thereby greatly reducing the cost of the injectors. The improved fuel injector module is well-suited for use with engines having two banks of cylinders. A compact and preferably non-metallic module houses all of the injectors and electrical connections required for both cylinder banks. The injectors are substantially sealed from the environment, thereby eliminating the need for protective overmolding. Furthermore, the injector module can be directly attached to the intake manifold. Only a single fuel connection and a single electrical connection is required to supply fuel and power to all of the injectors in the injector module. The injector module can also be equipped with features to improve the atomization of fuel as it exits the fuel injectors.

More specifically, the invention provides a fuel injector module for an internal combustion engine having two banks of cylinders. The injector module includes a longitudinally extending central portion with opposing sides, at least two branches extending laterally from one of the opposing sides, and at least two more branches extending laterally from the other of the opposing sides. Each of the branches has therein an injector receptacle. A fuel injector is housed in each injector receptacle for injecting fuel into a respective cylinder.

In one aspect of the invention, each of the branches includes an electrical connector adjacent the respective injector receptacle for providing electrical power to the respective fuel injector. Preferably, each of the electrical connectors includes a pogo-pin electrically coupled to the respective fuel injector. In another aspect of the invention, the central portion houses a wire harness that is electrically coupled to each of the electrical connectors.

In yet another aspect of the invention, each branch includes a fuel feed passageway communicating with the respective injector receptacle. A fuel supply line communicates with each fuel feed passageway to supply fuel to each of the injectors. In another aspect of the invention, each branch includes an atomization chamber adjacent the outlet end of the fuel injector. An air supply passageway in the branch communicates with the atomization chamber and with an air supply line to supply air to the atomization chamber. The air supply improves the atomization of the fuel exiting the injector.

In an additional aspect of the invention, each branch includes a base portion and a cover portion. The fuel injector is sandwiched between the base portion and the cover portion. A seal member is also sandwiched between each respective base and cover portion to substantially seal the fuel injector from the environment.

The invention also provides a fuel injector module having improved electrical connections. The injector module includes a body portion, a fuel injector housed in the body portion, and a pogo-pin connector having a pogo-pin electrically coupled to the fuel injector to provide electrical power to the fuel injector. Preferably, the fuel injector includes two spaced-apart terminals, and the pogo-pin connector includes first and second pogo-pins. The first pogo-pin is electrically coupled to one of the terminals and the second pogo-pin is electrically coupled to the other of the terminals. The pogo-pin connector also preferably includes a housing that is movable with respect to the body portion to facilitate insertion and removal of the fuel injector from the body portion.

Other features and advantages of the invention will become apparent to those skilled in the art upon review of the following detailed description, claims, and drawings.

Figure 1:
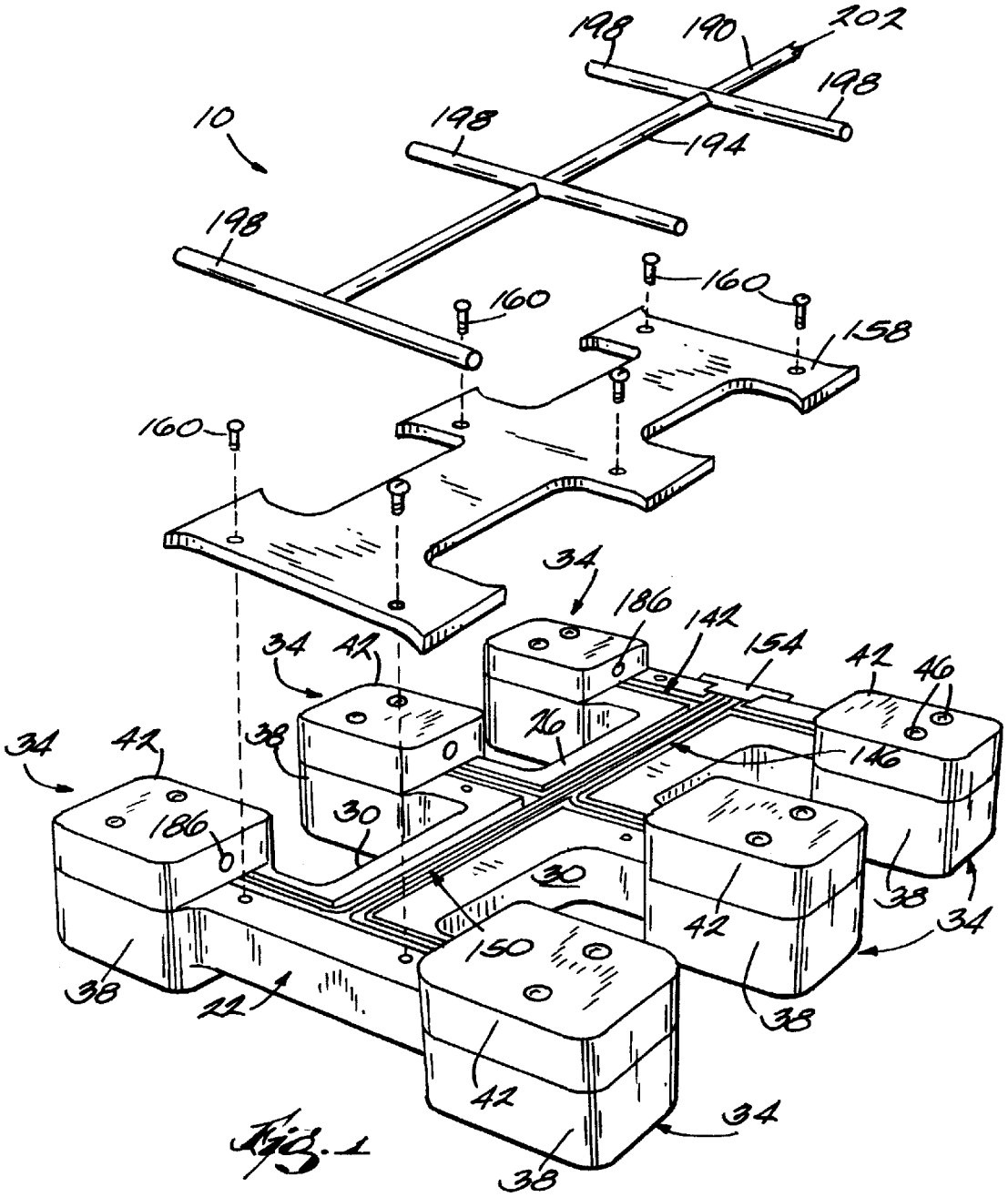
FIG. 1 is an exploded perspective view of a fuel injector module embodying the present invention.

Before one embodiment of the invention is explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein is for the purpose of description and should not be regarded as limiting. The use of "including" and "comprising" and variations thereof herein is meant to encompass the items listed thereafter and equivalents thereof as well as additional items.

DETAILED DESCRIPTION OF THE PREFERRED EMBODIMENT

FIG. 1 illustrates a fuel injector module 10 embodying the invention. The fuel injector module 10 is mounted to an air intake module 14 (shown schematically in FIG. 7) that communicates with two banks of cylinders 18 (also shown schematically in FIG. 7) of an internal combustion engine. Alternatively, the injector module 10 can be mounted directly to the cylinder head (not shown). Any suitable fasteners (not shown) can be used to mount the injector module 10 to the air intake manifold 14 or the cylinder head.

The injector module 10 includes body portion 22 having a longitudinally-extending central portion 26 with opposing sides 30. At least two branches 34 extend laterally from each of the opposing sides 30 of the central portion 26. In the illustrated embodiment, three branches 34 extend from each of the opposing sides 30 to accommodate a six-cylinder engine, however the number of branches can vary depending on the number of cylinders 18. While the branches 34 are illustrated as being symmetrically arranged about the central portion 26, this symmetrical arrangement is not necessary.

Each branch 34 includes a base portion 38 and a cover portion 42. The cover portions 42 are secured to the respective base portions 38 with fasteners 46. Of course, other methods of securing the cover portions 42 to the base portions 38 can also be used. Alternatively, the cover portions 42 could be integrally formed with the base portions 38. The cover portions 42 will be described in greater detail below. The body portion 22 (including the cover portions 42) can be made of any suitable metal or plastic, and is preferably molded plastic or cast aluminum.

Figure 3:
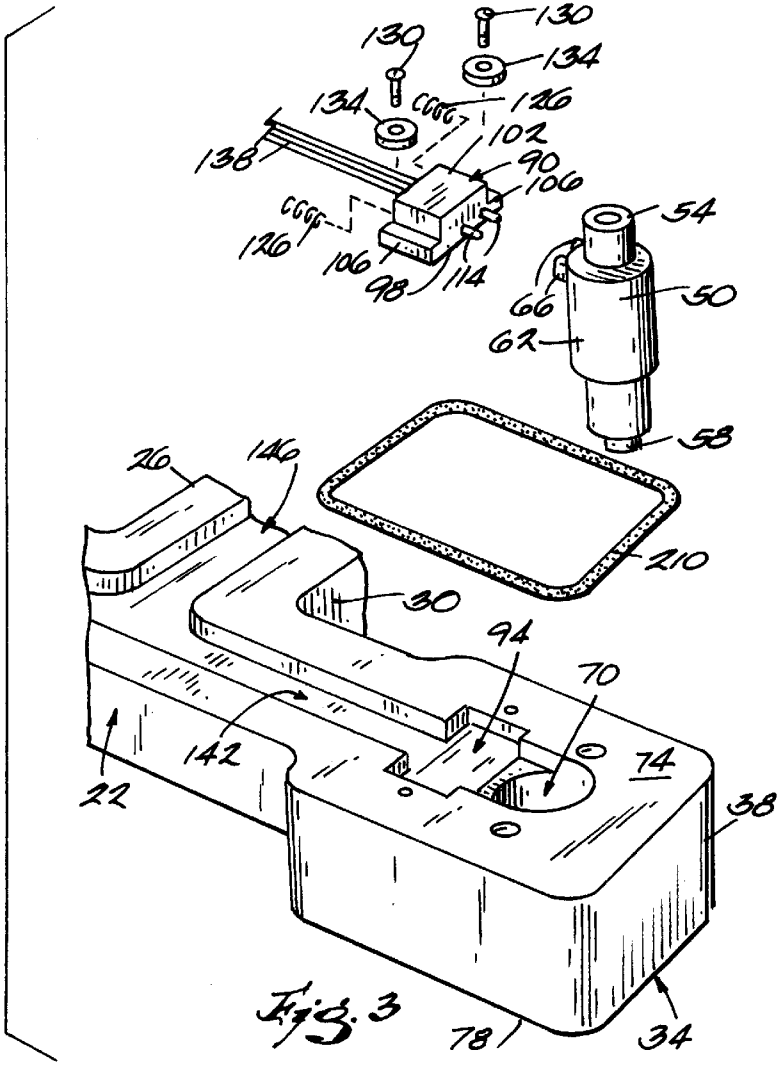
FIG. 3 is an exploded perspective view showing components of the base portion of the branch of FIG. 2.
Figure 2:
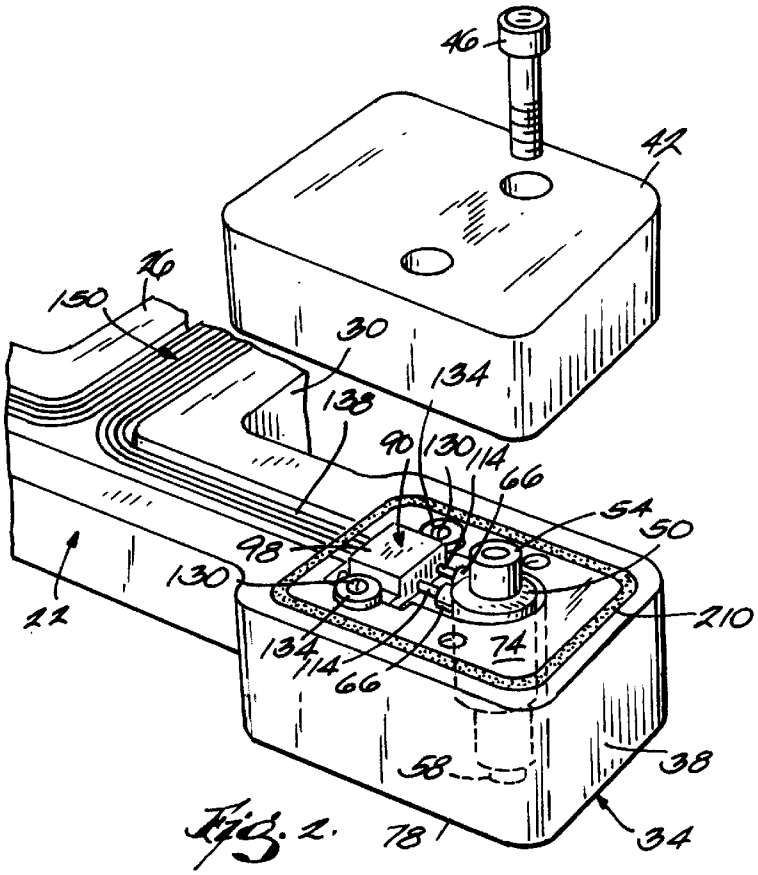
FIG. 2 is a perspective view of a portion of the fuel injector module of FIG. 1 showing a cover portion of one branch removed.
Figure 5:
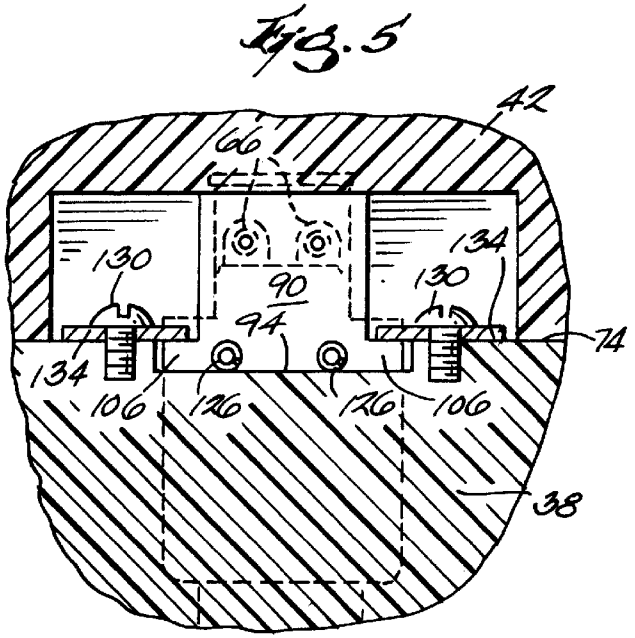
FIG. 5 is a section view taken along line 5—5 in FIG. 4.
Figure 4:
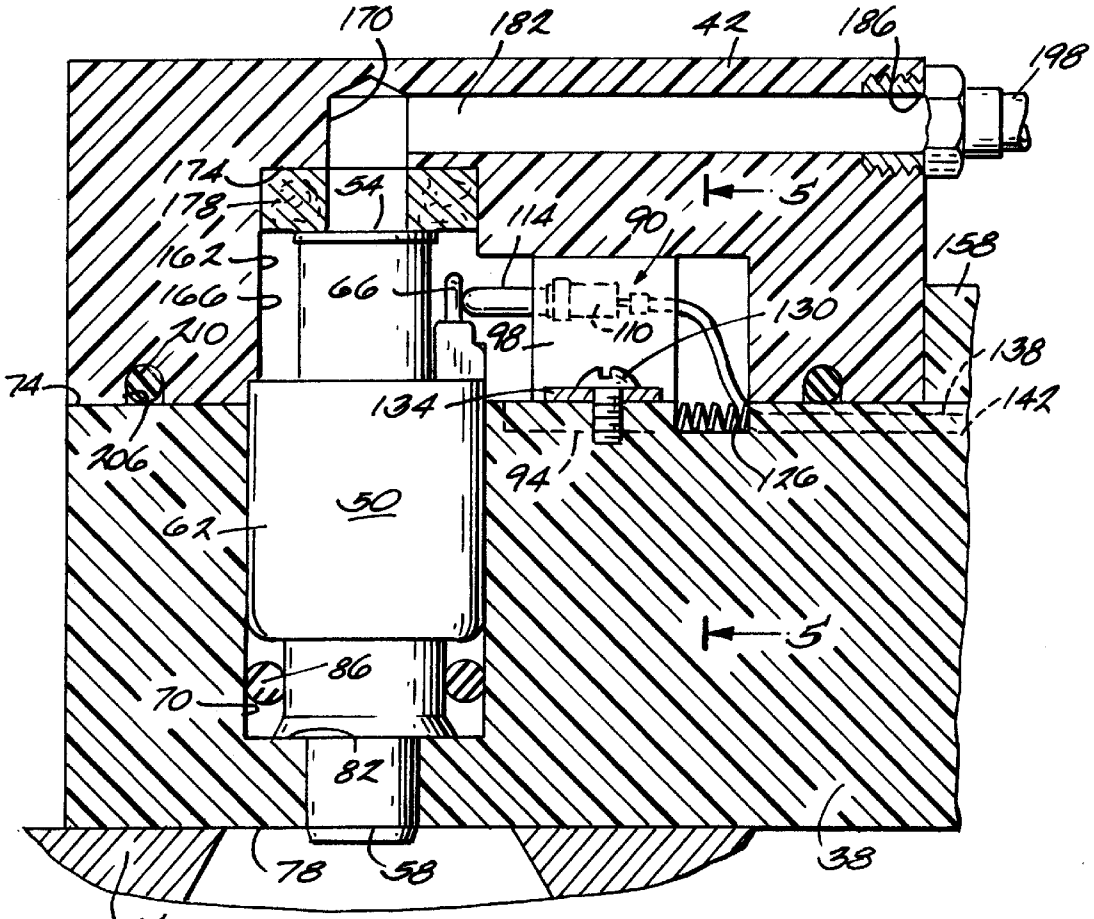
FIG. 4 is a section view through one of the branches of the fuel injector module of FIG. 1.

Each of the branches 34 is substantially identical and only one branch 34 will be described in detail. Each branch 34 is configured to retain a fuel injector 50 for supplying fuel to the engine. The injector 50 shown in FIGS. 2–4 is actually the functional group of a standard Bosch EV14 fuel injector. In other words, a standard Bosch EV14 injector is stripped of any extra parts such as extension tubes, electrical connection extensions, and any other features or components needed to elongate the injectors. Furthermore, the functional group is not overmolded. Therefore, the cost of the injector 50 is reduced and a new injector need not be designed to fit in the injector module 10. By using only the functional group of a standard injector, both the overall envelope of the engine and the size of the injector module 10 are greatly reduced. Of course, other functional groups can also be used in the injector module 10, however, substitutions may require modifications to the injector module 10.

Referring now to FIGS. 2–4, each injector 50 includes a fuel inlet end 54 and a fuel outlet end 58. An electromagnetic coil (not shown) is housed in a body portion 62 of the injector 50 to open and close the injector valve as is understood. Terminals 66 are coupled to the coil and extend from the body portion 62 to be electrically coupled to a power supply (not shown). Electricity is selectively applied to the coil via the terminals 66 to open and close the injector valve. When the injector valve is open, fuel flows into the inlet end 54, through the body portion 62, and out through the outlet end 58. When the injector valve is closed, fuel cannot exit the outlet end 58. To retain the injector 50 in the branch 34, the base portion 38 includes an injector receptacle 70 extending between a top surface 74 and a bottom surface 78 of the base portion 38. The terms "top" and "bottom" are used for purposes of description only, and are not intended to imply any particular orientation. Preferably, the injector receptacle 70 includes a seat in the form of a step 82 (see FIG. 4) that prevents the injector 50 from falling out of the injector receptacle 70 through the bottom surface 78. As seen in FIG. 4, the outlet end 58 of the injector 50 extends past the step 82 and out of the bottom surface 78 of the base portion 38 to communicate with the air intake manifold 14. An O-ring 86 is positioned on the body portion 62 of the injector 50 to sealingly engage the inner wall of the injector receptacle 70, thereby substantially preventing fuel from flowing toward the top surface 74 through the injector receptacle 70.

The base portion 38 also houses an electrical connector 90 that is retained in a recess 94 (see FIG. 4) in the top surface 74. The recess 94 is adjacent the injector receptacle 70 so that the electrical connector 90, when placed in the recess 94, is in electrical contact with the terminals 66 as will be described below.

Figure 6:
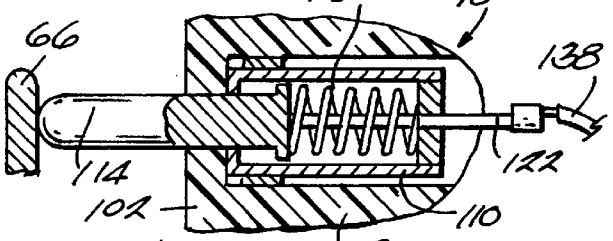
FIG. 6 is an enlarged section view showing the pogo-pin electrical connection.

The electrical connector 90 includes a housing 98 having a body portion 102 and flanges 106 extending from opposite sides of the body portion 102. A pair of pogo-pins 110 are housed in the body portion 102 for electrically contacting the terminals 66. As best seen in FIG. 6, each pogo-pin 110 has a contact end 114 that extends out of the body portion 102 and is biased outwardly, toward the terminals 66, by a spring 118 inside the pogo-pin 110. The contact ends 114 are electrically connected to leads 122 that extend out of the body portion 102 on the opposite side of the contact ends 114. The illustrated pogo-pins 110 are available from Everett Charles Technologies of Pomona, Calif., however, any suitable pogo-pins 110 can be used.

As best seen in FIG. 4, the housing 98 is slidably movable in the recess 94 and is biased toward the injector receptacle 70 by springs 126. The relative motion between the housing 98 and the base portion 38 provides clearance for installing the injector 50 into the injector receptacle 70. To install the injector 50, the installer slides the housing 98 away from the injector receptacle 70 against the bias of the springs 126. Once the injector 50 is installed in the injector receptacle 70, the installer releases the housing 98, which will slide toward the terminals 66. The contact ends 114 contact the terminals 66 and the electrical connection between the injector 50 and the electrical connector 90 is made. The outward bias and the relative range of motion of the contact ends 114 ensures that the electrical contact between the connector 90 and the terminals 66 will be maintained during operation. Injectors 50 can be removed and replaced as necessary.

As best seen in FIGS. 2–5, the electrical connector 90 is retained in the recess 94 using fasteners 130 and washers 134. Each washer 134 engages both the top surface 74 and a top surface of the flange 106 to retain the electrical connector 90 in the recess 94 when the fastener 130 is tightened. The washers 134 prevent the electrical connector 90 from moving upwardly out of the recess 94, but accommodate the sliding movement of the housing 98 described above. Other suitable methods of retaining the electrical connector 90 can also be used.

The leads 122 of the pogo-pins 110 are electrically connected to lead wires 138 that are housed in recessed guideway 142 (see FIGS. 3 and 4) formed in the base portion 38. The recessed guideway 142 communicates with a recessed guideway 146 (see FIG. 3) in the central portion 26. The lead wires 138 from each branch 34 extend into the guideway 146 and form a wire harness assembly 150 that terminates at a single pin connector 154 (see FIG. 1) at one end of the central portion 26. With this construction, only one electrical connection to the injector module 10 is needed to supply electricity to all of the injectors 50.

As seen in FIG. 1, a cover plate 158 is positioned between the cover portions 42 and over the guideways 142, 146 to protect the wire harness assembly 150. Fasteners 160 are used to secure the cover plate 158. It should be noted that the cover plate 158 need not be a separate piece, but rather could be integrated with the cover portions 42 to form an integral cover member (not shown).

With the injector 50 positioned in the base portion and electrically connected to the electrical connector 90, the cover portion 42 is secured to the top surface 74 to sandwich the injector 50 and the electrical connector 90 between the base portion 38 and the cover portion 42. The cover portion 42 includes an injector receptacle 162 that receives the fuel inlet end 54 of the injector 50. The injector receptacle 162 has a large diameter portion 166 and a small diameter portion 170 separated by a seat in the form of a step 174. A sealing member 178 is positioned between the step 174 and the inlet end 54 of the injector 50 to provide a seal between the small diameter portion 170 and the inlet end 154. The sealing member 178 is preferably a flat annular disk. Alternatively, the sealing member 178 can be in the form of an O-ring.

A fuel feed passageway 182 communicates with the small diameter portion 170 to provide fuel to the inlet end 54 of the injector 50. Fuel flows into the fuel feed passageway 182 through an inlet 186 (see FIGS. 1 and 4), travels into the small diameter portion 170, and into the inlet end 54 through the sealing member 178. The sealing member 178 substantially prevents fuel from entering the large diameter portion 166 of the injector receptacle 162.

As seen in FIG. 1, fuel is supplied to each fuel feed passageway 182 by a fuel supply line 190. The fuel supply line 190 preferably includes a central portion 194 and a plurality of injector feeding portions 198 communicating with the central portion 190 and the respective cover portions 42. As seen in FIG. 4, the outlet ends of the injector feeding portions 198 are threaded into the inlets 186 of the fuel feed passsageways 182. Other types of connections between the injector feeding portions 198 and the fuel feed passageways 182 can also be used, including various press-fit, snap-fit, and interference-fit configurations. Fuel is supplied to the fuel supply line 190 at an inlet 202 at one end of the central portion 194. With this construction, only one fuel connection to the injector module 10 is needed to supply fuel to all of the injectors 50.

The cover portion 42 preferably includes a seal groove 206 (see FIG. 4) that houses a sealing member 210 (also shown removed from the seal groove 206 in FIGS. 2 and 3). The sealing member 210 can be secured in the groove 206 or can be removable. When the cover portion 42 is secured to the base portion 38, the sealing member 210 rests in the groove 206 and engages the top surface 74 of the base portion 38 to substantially seal the components housed in the branch 34 from the environment. Of course, the groove 206 could alternatively be formed in the top surface 74 of the base portion 38, or a groove could be formed in each of the base and cover portions 38, 42. As mentioned above, because the branch 34 is substantially sealed via the O-ring 86 and the sealing members 178 and 210, there is no need to overmold the injector 50 with a protective coating.

Figure 8:
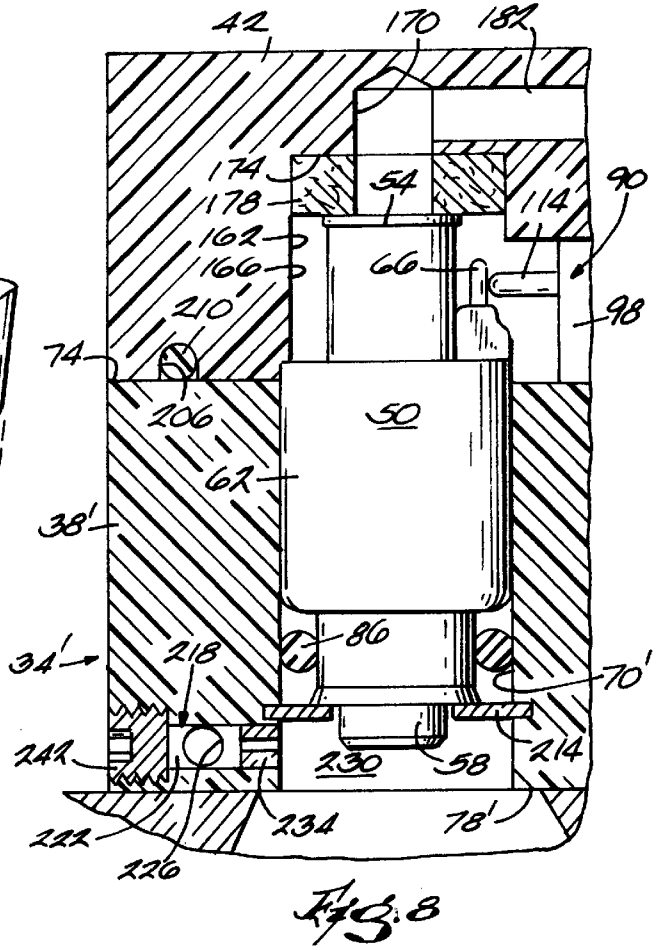
FIG. 8 is a section view through one of the branches of the fuel injector module of FIG. 7.
Figure 7:
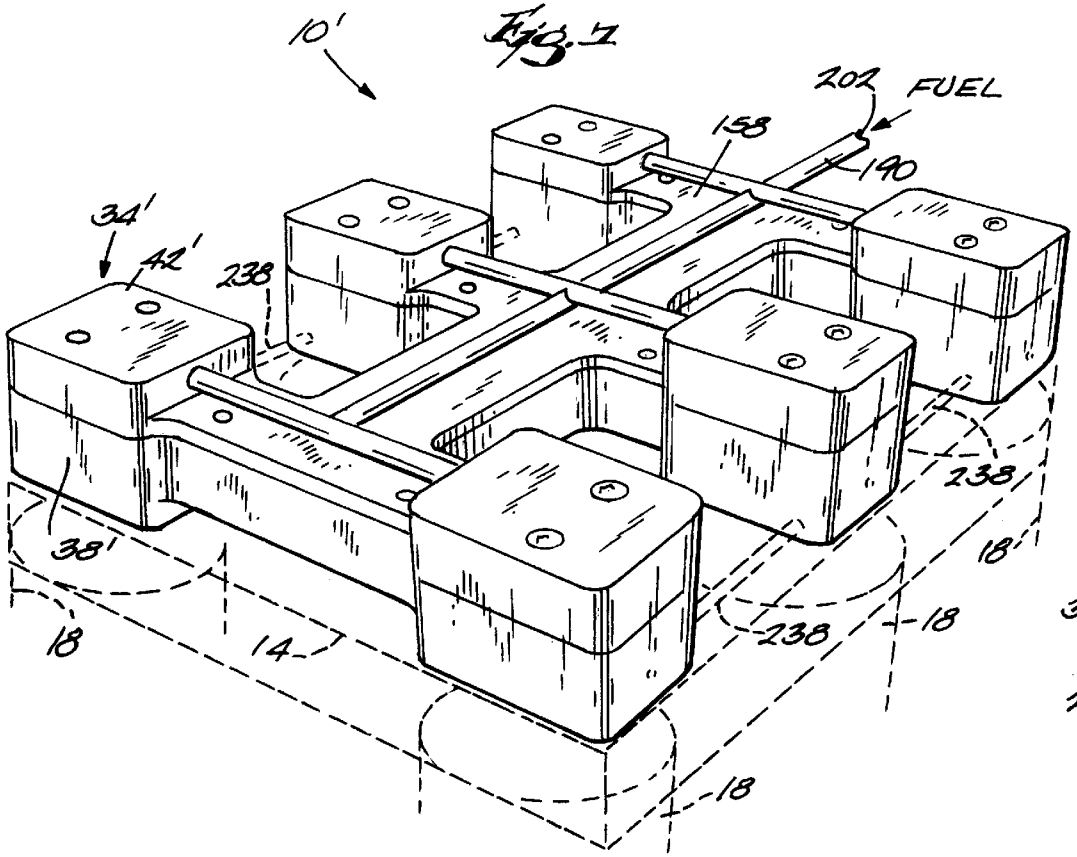
FIG. 7 is an alternative fuel injector module having air-assist features and bottom-loading features.

FIGS. 7 and 8 illustrate an injector module 10' that differs slightly from the injector module 10. The injector module 10' includes two features that can be used in addition to and/or in place of the features described above with respect to the injector module 10. Like features have been given like reference numerals, while modified features are indicated as primes (').

First, and as shown in FIG. 8, the injector module 10' includes a bottom-load feature that allows the injector 50 to be inserted into the base portion 38' from the bottom surface 78' instead of loading the injector from the top surface 74 as with the injector module 10. The injector receptacle 70' does not include the step 82. Rather, the injector 50 is retained in the injector receptacle 70' by a retaining ring 214 in the form of a snap-ring, a C-ring, or a bevel washer that rests in a groove in the wall of the injector receptacle 70'.

By using this bottom-load feature, it may be possible to make the cover portion 42' integral with the base portion 38'. In the event the base portion 38' and the cover portion 42' are integrally formed, the electrical connector 90 is insert-molded in the branch 34'. Since the injector 50 is loaded from the bottom surface 78' of the branch 34', the body portion 102 of the electrical connector 90 need not move relative to the base portion 38' in order to install the injector 50. Therefore, the springs 126 would be eliminated. Rather, the range of motion of the contact ends 114 with respect to the terminals 66 would permit installation of the injector 50. The sealing member 178 could also be insert-molded, or alternatively, could be inserted into the injector receptacle 70' prior to installing the injector 50.

The injector module 10' also includes an air-assist feature. The air-assist feature can be used with either the bottom-load design shown in FIG. 8 or the top-load design shown in FIGS. 2–4. The air assist feature helps atomize the fuel being sprayed from the outlet end 58 of the injector 50. As seen in FIG. 8, the each portion 38' includes an air supply passageway 218 including a lateral passageway 222 and a longitudinal passageway 226. The lateral passageway 222 communicates with an atomization chamber 230, which is the portion of the injector receptacle 70' below the retaining ring 214 (or the step 82 in the injector module 10), adjacent the outlet end 58 of the injector 50.

The lateral passageway 222 is formed from the side of the base portion 38' opposite to the central portion 26. A restrictor 234 is positioned in the lateral passageway to restrict and regulate the flow of air into the atomization chamber 230. Alternatively, the lateral passageway 222 can be sized such that no restrictor 234 is needed.

The longitudinal passageway 226 intersects the lateral passageway 222 and supplies air to the lateral passageway 222 from air supply lines 238 (shown in phantom in FIG. 7. The air supply lines 238 are connected to the branches in any suitable manner, such as the connections described above with respect to the fuel supply line 190. Plugs 242 close off the lateral passageway 222 so that air must either flow through the restrictor 234 into the atomization chamber 230, or continue through the longitudinal passageway 226 to the next branch 34'. With this construction, only two air connections to the injector module 10' are needed to supply air to all of the branches 34'. Of course, other air supply configurations could also be used.

It should be noted that many of the components of the intake modules 10, 10' could be made integral to reduce the number of parts. As mentioned above, the cover plate 158 and the cover portions 42 could be a single part. Additionally, the fuel supply line 190 could be made integral with the cover plate 158 by forming a series of passageways inside a thicker cover plate 158 to function as the fuel supply line 190. Again, this integral cover plate and fuel supply line could also be integral with the cover portions 42. If the bottom-loading feature were used, it would even be possible to combine the body portion 22 (including the central portion 26, the base portions 38, and the cover portions 42), the cover plate 158, and the fuel supply line 190 into a single part. This would involve insert-molding the electrical connectors 90 as described above, as well as the wire harness assembly 150 and the electrical pin connector 154.

Various features of the invention are set forth in the following claims:

1. A fuel injector module for an internal combustion engine having two banks of cylinders, the injector module comprising:

a longitudinally extending central portion with opposing sides;

at least two branches extending laterally from one of the opposing sides and at least two more branches extending laterally from the other of the opposing sides, each of the branches having therein an injector receptacle;

a fuel injector housed in each injector receptacle for injecting fuel into a respective cylinder; and a fuel supply line communicating with each of the branches to supply fuel to each of the injectors, the fuel supply line being distinct from and external to the central portion.

2. The injector module of claim 1, wherein each of the branches further includes an electrical connector adjacent the respective injector receptacle for providing electrical power to the respective fuel injector.

3. The injector module of claim 2, wherein each of the electrical connectors includes a pogo-pin electrically coupled to the respective fuel injector.

4. The injector module of claim 2, wherein each of the electrical connectors is electrically coupled to a wire harness housed in the central portion.

5. The injector module of claim 4, further comprising:

a cover for covering the wire harness housed in the central portion.

6. The injector module of claim 1, wherein each of the branches includes a fuel feed passageway communicating with the respective injector receptacle and having an inlet, and wherein the fuel supply line includes a central portion and a plurality of injector feeding portions corresponding to the branches and extending laterally from opposing sides of the central portion of the fuel supply line to the respective fuel feed inlets.

7. The injector module of claim 6, further comprising:

a plurality of sealing members, each sealing member being positioned between a respective inlet end of the fuel injector and a respective fuel feed passageway to substantially prevent the leakage of fuel into the respective injector receptacle.

8. The injector module of claim 1, wherein the fuel supply line has a single fuel inlet.

9. The injector module of claim 1, wherein each of the injector receptacles includes a seat for retaining the fuel injector in the injector receptacle.

10. The injector module of claim 1, further comprising:

a plurality of retaining rings, each retaining ring retaining a respective one of the fuel injectors in the respective injector receptacle.

11. The injector module of claim 1, wherein each of the injector receptacles includes an atomization chamber defined therein adjacent an outlet end of the fuel injector to improve atomization of a fuel exiting the outlet end of the fuel injector.

12. The injector module of claim 11, wherein each of the branches includes an air supply passageway for supplying air to the atomization chamber, the air supply passageway having a restrictor for regulating the flow of air through the air supply passageway.

13. The injector module of claim 12, further comprising: at least one air supply line communicating with the air supply passageways to supply air to the atomization chambers.

14. The injector module of claim 1, wherein each of the fuel injectors includes an O-ring for sealingly engaging the injector receptacle.

15. The injector module of claim 1, wherein each branch includes a base portion and a cover portion and wherein each fuel injector is sandwiched between the respective base portion and cover portion.

16. The injector module of claim 15, further comprising:

a plurality of sealing members, each sealing member being sandwiched between a respective base portion and a respective cover portion to substantially seal the respective fuel injector from the environment.

17. A fuel injector module for an internal combustion engine having two banks of cylinders, the injector module comprising:

a longitudinally extending central portion with opposing sides;

at least two branches extending laterally from one of the opposing sides and at least two more branches extending laterally from the other of the opposing sides, each of the branches having therein an injector receptacle; and a fuel injector housed in each injector receptacle for injecting fuel into a respective cylinder;

wherein each branch includes a base portion and a cover portion and wherein each fuel injector is sandwiched between the respective base portion and cover portion.

18. The injector module of claim 17, further comprising:

a plurality of sealing members, each sealing member being sandwiched between a respective base portion and a respective cover portion to substantially seal the respective fuel injector from the environment.

19. The injector module of claim 17, wherein each of the branches further includes an electrical connector adjacent the respective injector receptacle for providing electrical power to the respective fuel injector.

20. The injector module of claim 19, wherein each of the electrical connectors includes a pogo-pin electrically coupled to the respective fuel injector.

21. The injector module of claim 19, wherein each of the electrical connectors is electrically coupled to a wire harness housed in the central portion.

22. The injector module of claim 21, further comprising:

a cover for covering the wire harness housed in the central portion.

23. The injector module of claim 17, further comprising:

a fuel supply line communicating with each of the branches to supply fuel to each of the injectors.

24. The injector module of claim 23, wherein each of the branches includes a fuel feed passageway communicating with the respective injector receptacle and having an inlet, and wherein the fuel supply line includes a central portion and a plurality of injector feeding portions corresponding to the branches and extending laterally from opposing sides of the central portion of the fuel supply line to the respective fuel feed inlets.

25. The injector module of claim 24, further comprising:

a plurality of sealing members, each sealing member being positioned between a respective inlet end of the fuel injector and a respective fuel feed passageway to substantially prevent the leakage of fuel into the respective injector receptacle.

26. The injector module of claim 23, wherein the fuel supply line has a single fuel inlet.

27. The injector module of claim 17, wherein each of the injector receptacles includes a seat for retaining the fuel injector in the injector receptacle.

28. The injector module of claim 17, further comprising:

a plurality of retaining rings, each retaining ring retaining a respective one of the fuel injectors in the respective injector receptacle.

29. The injector module of claim 17, wherein each of the injector receptacles includes an atomization chamber adjacent an outlet end of the fuel injector to improve atomization of a fuel exiting the outlet end of the fuel injector.

30. The injector module of claim 29, wherein each of the branches includes an air supply passageway for supplying air to the atomization chamber, the air supply passageway having a restrictor for regulating the flow of air through the air supply passageway.

31. The injector module of claim 30, further comprising:

at least one air supply line communicating with the air supply passageways to supply air to the atomization chambers.

32. The injector module of claim 17, wherein each of the fuel injectors includes an O-ring for sealingly engaging the injector receptacle.

33. A fuel injector module comprising:

a body portion;

a fuel injector housed in the body portion; and a pogo-pin connector having a pogo-pin electrically coupled to the fuel injector to provide electrical power to the fuel injector.

34. The injector module of claim 33, wherein the fuel injector includes two spaced-apart terminals, and wherein the pogo-pin connector includes first and second pogo-pins, the first pogo-pin being electrically coupled to one of the terminals and the second pogo-pin being electrically coupled to the other of the terminals.

35. A fuel injector module comprising:

a body portion;

a fuel injector housed in the body portion; and a pogo-pin connector having a pogo-pin electrically coupled to the fuel injector to provide electrical power to the fuel injector;

wherein the pogo-pin connector includes a housing that is movable with respect to the body portion to facilitate insertion and removal of the fuel injector from the body portion.

36. The injector module of claim 35, wherein the fuel injector includes two spaced-apart terminals, and wherein the pogo-pin connector includes first and second pogo-pins, the first pogo-pin being electrically coupled to one of the terminals and the second pogo-pin being electrically coupled to the other of the terminals.

37. A fuel injector module for an internal combustion engine having two banks of cylinders, the injector module comprising:

a longitudinally extending central portion with opposing sides, the central portion housing a wire harness;

at least two branches extending laterally from one of the opposing sides and at least two more branches extending laterally from the other of the opposing sides, each of the branches having therein an injector receptacle, an electrical connector electrically coupled to the wire harness, and a fuel feed passageway communicating with the injector receptacle;

a fuel injector housed in each injector receptacle for injecting fuel into a respective cylinder, each fuel injector being electrically coupled to the respective electrical connector; and a fuel supply line distinct from and external to the central portion and communicating with each of the fuel feed passageways to supply fuel to each of the branches.

* * * * *